US008819993B1

(12) United States Patent
Chen

(10) Patent No.: US 8,819,993 B1
(45) Date of Patent: Sep. 2, 2014

(54) COVERING OF BUILDING'S OPENING

(71) Applicant: Nien Made Enterprise Co., Ltd., Taichung (TW)

(72) Inventor: Lin Chen, Taichung (TW)

(73) Assignee: Nien Made Enterprise Co., ltd., Taichung (TW)

( * ) Notice: Subject to any disclaimer, the term of this patent is extended or adjusted under 35 U.S.C. 154(b) by 0 days.

(21) Appl. No.: 13/786,687

(22) Filed: Mar. 6, 2013

(51) Int. Cl.
*E05D 15/06* (2006.01)
*E05F 11/06* (2006.01)

(52) U.S. Cl.
CPC ..... *E05F 11/06* (2013.01)
USPC ..... 49/125; 49/127; 49/165; 160/195; 160/199

(58) Field of Classification Search
USPC ..... 49/125, 127, 129, 130, 164, 165, 404, 49/409, 425; 160/118, 194, 195, 199, 206, 160/213
See application file for complete search history.

(56) References Cited

U.S. PATENT DOCUMENTS 2,408,525 A * 10/1946 Miller et al. ..... 160/36
3,029,868 A * 4/1962 Ogburn et al. ..... 160/118
3,054,118 A * 9/1962 Bullock ..... 4/607
3,138,474 A * 6/1964 Reiss et al. ..... 160/206
3,144,077 A * 8/1964 Dickinson et al. ..... 160/206
3,342,246 A * 9/1967 Reiss ..... 160/195
3,692,083 A * 9/1972 Swanson et al. ..... 160/206
4,619,074 A * 10/1986 Leung et al. ..... 49/143
6,170,195 B1 * 1/2001 Lim ..... 49/196
6,209,613 B1 * 4/2001 Forry ..... 160/199
6,422,287 B1 * 7/2002 Wilke ..... 160/92
7,451,802 B2 * 11/2008 Cianciolo et al. ..... 160/211
7,950,439 B2 * 5/2011 Anderson ..... 160/211

FOREIGN PATENT DOCUMENTS

JP 2011046271 A * 3/2011

* cited by examiner

*Primary Examiner* — Katherine Mitchell
*Assistant Examiner* — Abe Massad
(74) *Attorney, Agent, or Firm* — Ming Chow; Sinorica, LLC

(57) ABSTRACT

A window includes a frame, a rail module, and two sashes. The rail module includes a first rail, a second rail, and a pulley assembly. The first rail is fixed to the frame, and the second rail is able to turn. The second rail is turned to connect to the first rail so that the pulley assembly can slide in both the first and the second rails. The first sash is pivoted on the frame, and the second sash is hinged with the first sash and connected to the pulley assembly. The pulley assembly is moved to the second rail from the first rail to make the sashes fold up. After the second sash arrives at the second rail, one may turn the folded sashes totally off the window and attach them to a wall besides the window.

7 Claims, 10 Drawing Sheets

COVERING OF BUILDING'S OPENING

BACKGROUND OF THE INVENTION

1. Field of the Invention

The present invention relates to a covering, and more particularly to a covering of a building's opening.

2. Description of the Related Art

A covering for an opening of a building, such as sashes for a window or doors for an entrance, has various types. Take a window covering for example, the common type window covering has two sliding or hinged sashes. In this type of window covering, the sashes take some space of the window. It is bad for ventilation.

Another type of window covering is similar to a casement window, having two hinged sashes, one of which is pivoted on the frame, and the other one of which is slidably engaged with a rail.

Move the sliding sash will fold the sashes, and the folded sashes are vertical to the rail. It provides a large window opening when a user opens the sashes.

However, people may run into the vertical sashes accidently when the sashes are opened. An improved window covering provides a warp rail, with which a user may move the folded sashes off the window and attach them to the wall beside the window. It is easy to understand that the warp rail is expensive and is difficult to manufacture. Furthermore, the warp rail makes the sashes move in a strange way. It is not good looking.

SUMMARY OF THE INVENTION

The primary objective of the present invention is to provide a covering of a building's opening, with which people will have less chance to run into the sashes when the sashes are opened.

According to the objective of the present invention, a rail module of a covering of a building's opening, including a fixed first rail, a second rail, a first restricting member, and a pulley assembly. The fixed first rail has a locking slot. The second rail is turned between a first position and a second position. The second rail is connected to the first rail when the second rail is turned to the first position, and the second rail is separated from the first rail when the second rail is turned to the second position. The first restricting member is movably provided on the second rail and has a contacting portion and a protrusion at opposite sides thereof. The protrusion engages the locking slot of the first rail when the second rail is turned to the first position. The pulley assembly is able to move in the first rail and the second rail when the second rail is turned to the first position. The pulley assembly has a driving portion in association with the contacting portion of the first restricting member.

The driving portion of the pulley assembly touches the contacting portion of the first restricting member to move the first restricting member and disengage the protrusion of the first restricting member with the locking slot of the first rail when the pulley assembly is moved to the second rail, so that the second rail is able to be turned to the second position.

Therefore, the hanger of the present invention provides the coverings to be moved totally off the building opening and attached to a wall besides the opening, while the rails of the present invention are straight.

DETAILED DESCRIPTION OF THE INVENTION

The detailed description and technical contents of the present invention will be explained with reference to the accompanying drawings. However, the drawings are illustrative only but not used to limit the present invention.

FIGS. from FIG. 1 to FIG. 6 show a covering of a building's opening of the embodiment of the present invention, in which the building's opening is a window, and the covering includes a frame 100, a rail module, and two sash members. Each sash member has two sashes 101, 102. These two sash members are symmetrical. So, only the left sash member is described hereafter.

Figure 7:
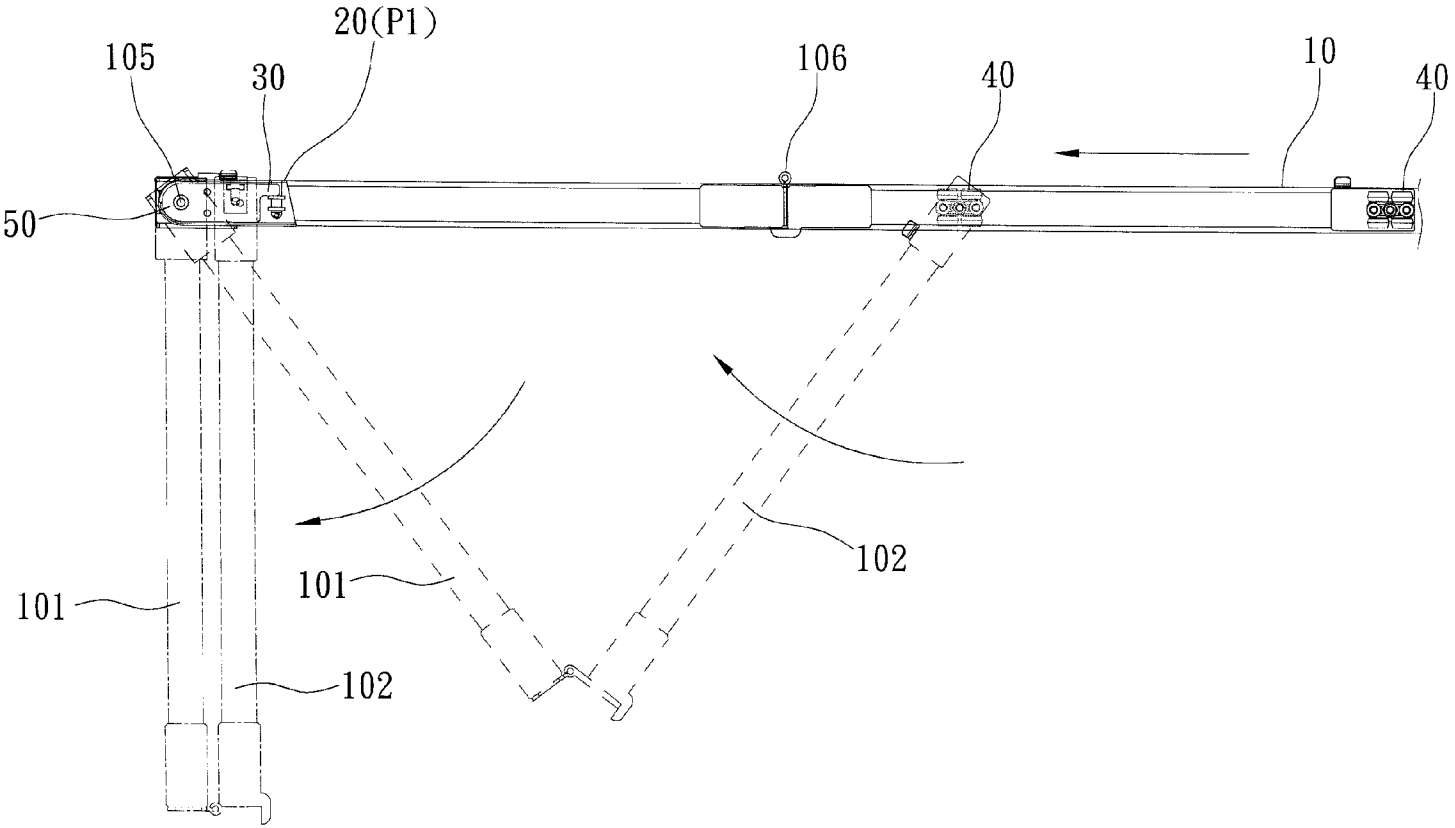
FIG. 7 is a top view of the window of the preferred embodiment of the present invention, showing the movement of the sashes.
Figure 9:
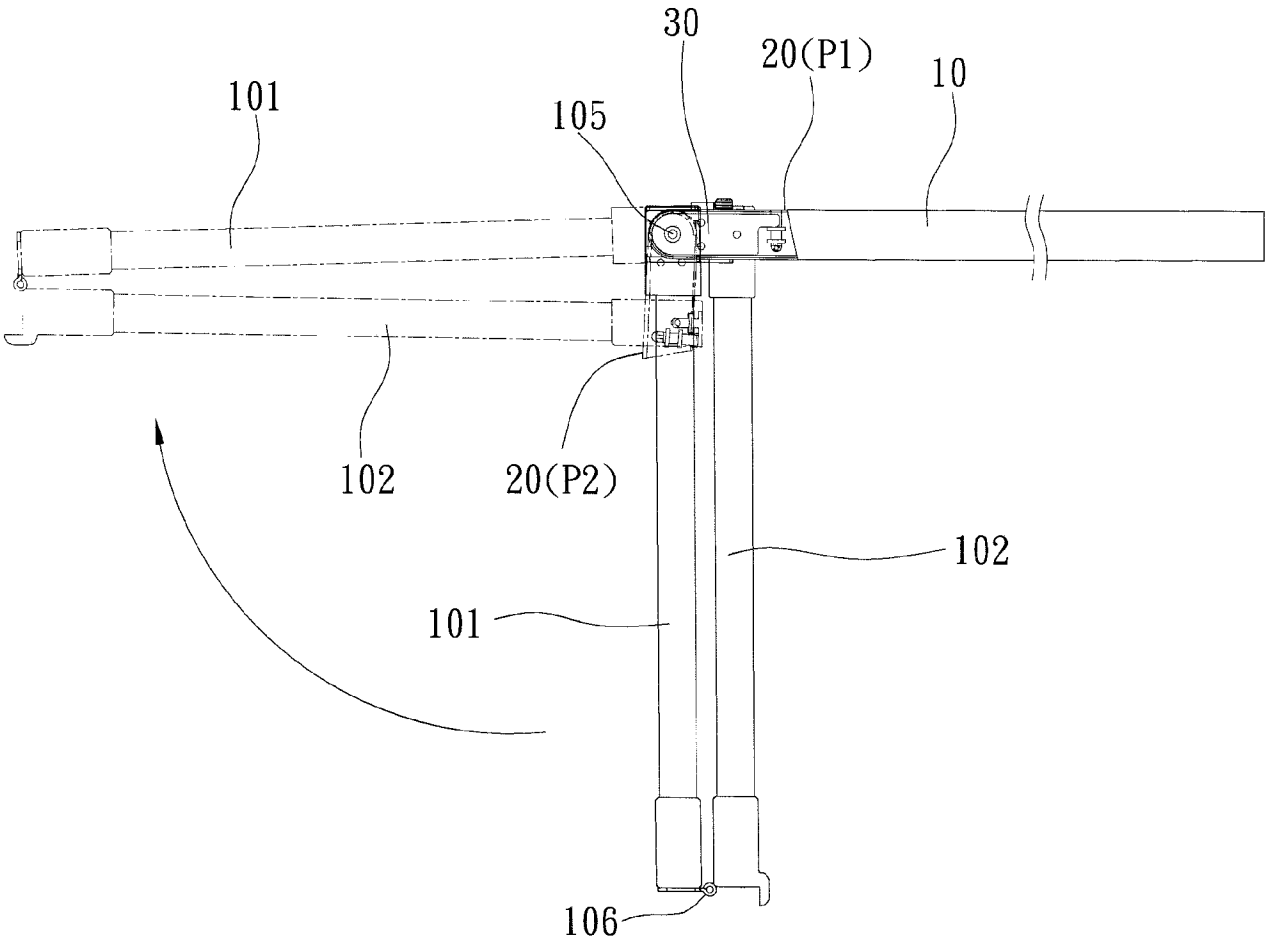
FIG. 9 is a top view of the preferred embodiment of the present invention, showing the movement of the sashes.

The frame 100 is mounted in the window, and the rail module is fixed to a top section of the frame 100. The first sash (so called first movable member) 101 is pivoted on the frame 100 by a pin 105 for rotation only. The first sash 101 is hinged with the second sash 102 by a hinge 106 (FIG. 7 and FIG. 9). The second sash (so called second movable member) 102 is engaged with the rail module to slide and rotate. The second sash 102 has a top side 102*a*.

The rail module includes a first rail 10 and a second rail 20. The rail module further has a fixed member 30, a pulley member 40, a base 50, a first restricting member 60, a first flexible member 70, a second restricting member 80, and a second flexible member 90 for each sash member.

The first rail 10 is straight, and is fixed to the frame 100. The sashes 101, 102 are under the first rail 10. The first rail 10 has a locking slot 12 adjacent to a left ends thereof.

The second rail 20 is next to one end of the first rail 10. The second rail 20 is pivoted on the frame 100 to be turned between a first position P1 and a second position P2. An end of the second rail 20 is connected to the end of the first rail 10 to form a single straight rail when the second rail 20 is at the first position P1. The second rail 20 has a top plate 22 and two side plates 24 at opposite edges of the top plate 22. The top plate 22 has a transverse slot 221, and the transverse slot 221 is vertical to the second rail 20 and has an end open at the side plate 24.

The fixed member 30 is a plate fixed to the frame 100, and is above the top plate 22 of the second rail 20. The fixed member 30 has a protrusion 32 in association with the first rail 10.

Figure 5:
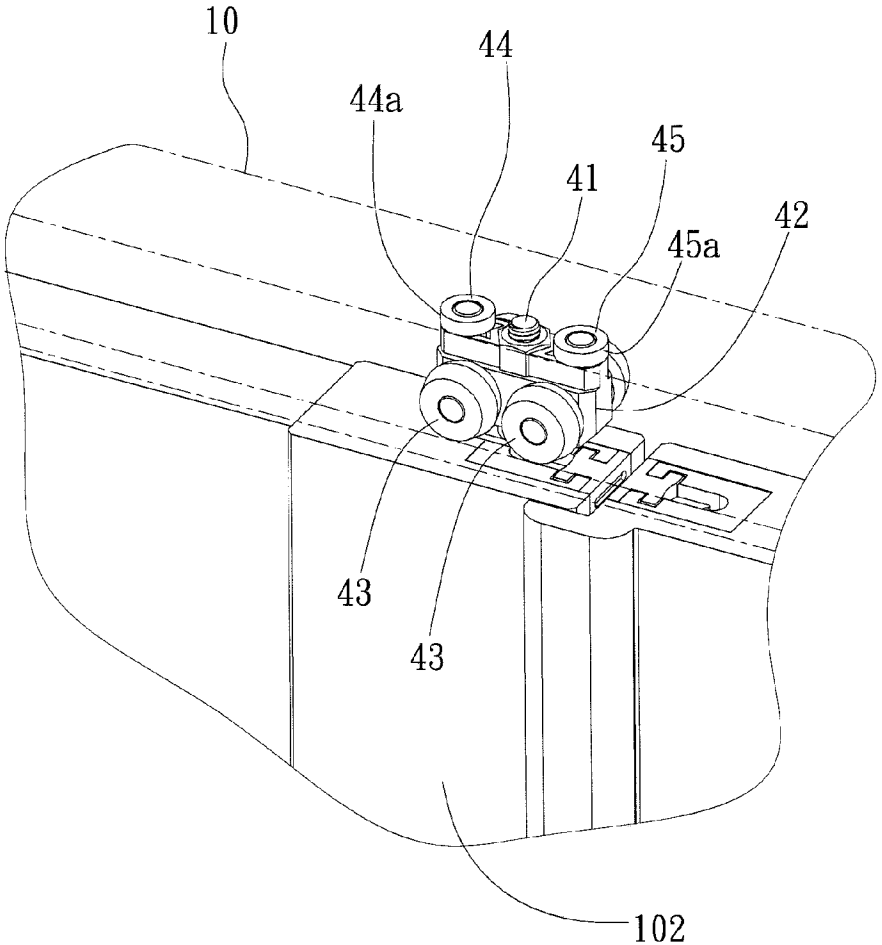
FIG. 5 is a perspective view of the pulley assembly and the first rail of the preferred embodiment of the present invention.
Figure 6:
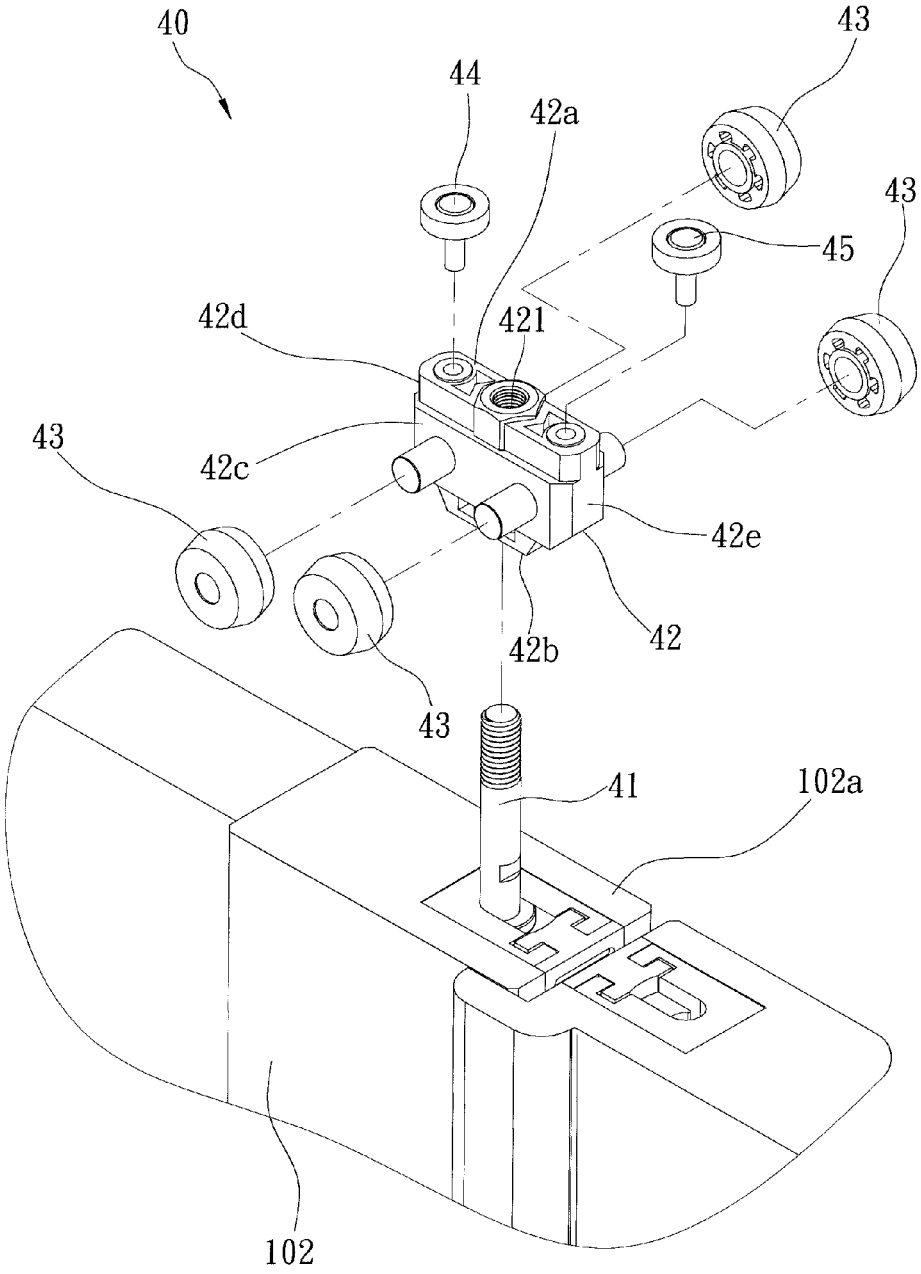
FIG. 6 is an exploded view of the pulley assembly of the preferred embodiment of the present invention.

As shown in FIG. 5 and FIG. 6, the pulley assembly 40 has a thread rod 41, a carrier 42, a plurality of pulleys 43, a front wheel 44, and a rear wheel 45. The thread rod 41 is on the top side 102*a* of the second sash 102. The carrier 42 is a rectangular-like block, having a top side 42*a* and a bottom side 42*b*, a left side 42*c*, a right side, a front side 42*d*, and a rear side 42*e*. The top side 42*a* is opposite to the bottom side 42*b*, and the rest sides are between the top side 42*a* and the bottom side 42*b*. The right side is opposite to the left side 42*c*, but is not shown the drawings. The rear side 42*d* is opposite to the front side 42*e*, and they are between the right side and the left side 42*c*. The carrier 42 is provided with a thread hole 421 extending from the top side 42*a* to the bottom side 42*b*. The thread rod 41 is screwed into the thread hole 421 to connect the carrier 42 to the second sash 102, so the carrier 42 is able to turn related to the second sash 102. The pulleys 43 are provided on the right side and the left side 42*c* of the carrier 42, and engage the first rail 10 so that the pulley assembly 40 is able to move in the first rail 10 and move to the second rail 20 while the second rail 20 is turned to the first position P1. The front wheel 44 and the rear wheel 45 are provided on the top side 42*a* of the carrier 42, and they respectively have a portion beyond front side 42*d* and the rear side 42*e* of the carrier 42. The beyond portions of the front wheel 44 and the rear wheel 45 form a driving portion 44*a* and a stop portion 45*a*.

The pin 105 of the first sash 101 is pivoted on the base 50, and a portion of the base 50 is in the second rail 20 so that the base 50 moves with the second rail 20. The base 50 has a rod 52 received in the second rail 20, and the rod 52 is pointed along the second rail 20.

The first restricting member 60 is movably received in the second rail 20. The first restricting member 60 has an elongated body with an elongated slot 62. The elongated slot 62 is open at an end of the body to form an opening end. The rod 52 of the base 50 enters the elongated slot 62 of the first restricting member 60 via the opening end. The first restricting member 60 further has contacting portion 64 on a lateral side of the body and adjacent the opening end of the elongated slot 62. The contacting portion 64 is a hook-like member. On the opposite end of the body, the first restricting member 60 has a protrusion 66.

Figure 2:
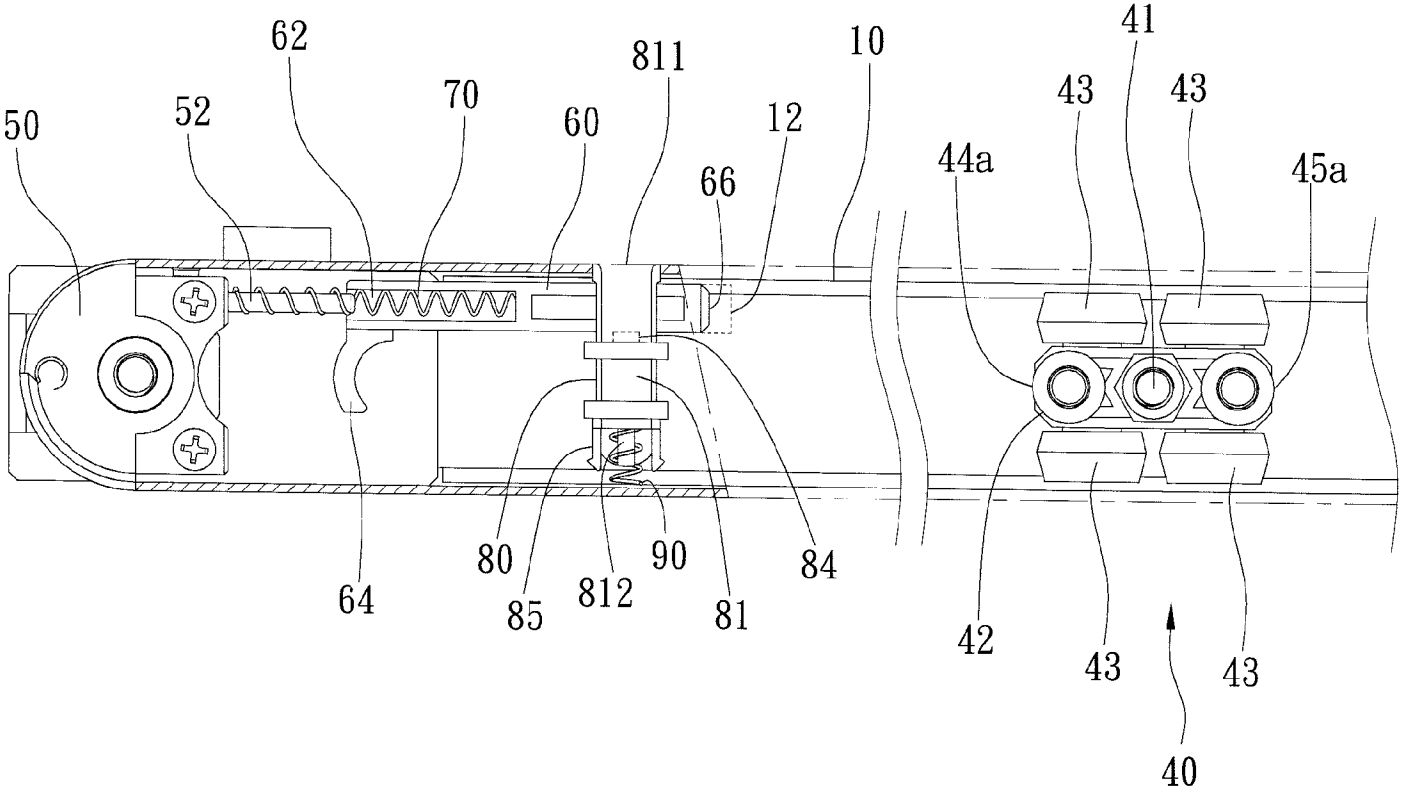
FIG. 2 is a sectional view of the preferred embodiment of the present invention.
Figure 3:
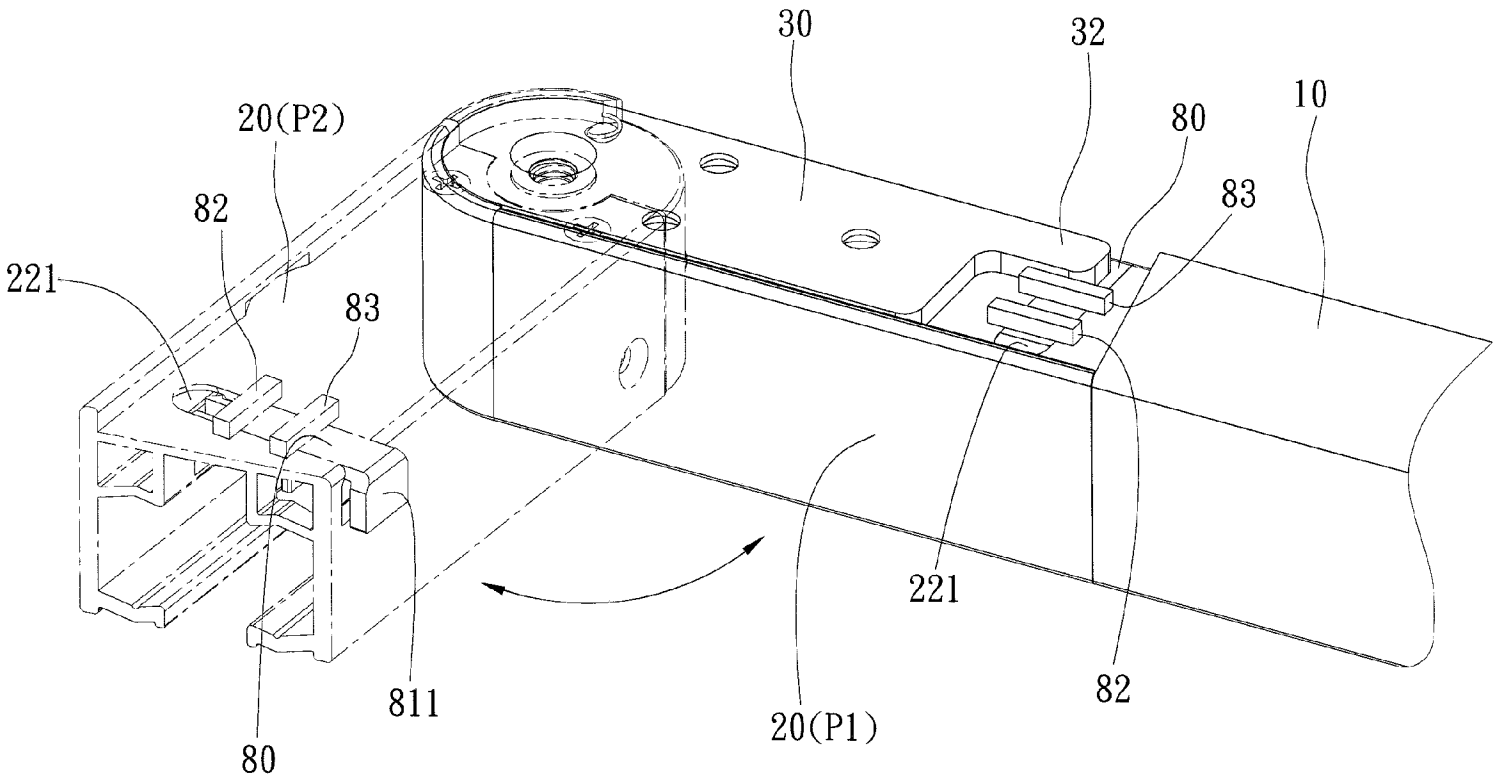
FIG. 3 is a perspective view of the preferred embodiment of the present invention, showing the movement of the second rail.
Figure 4:
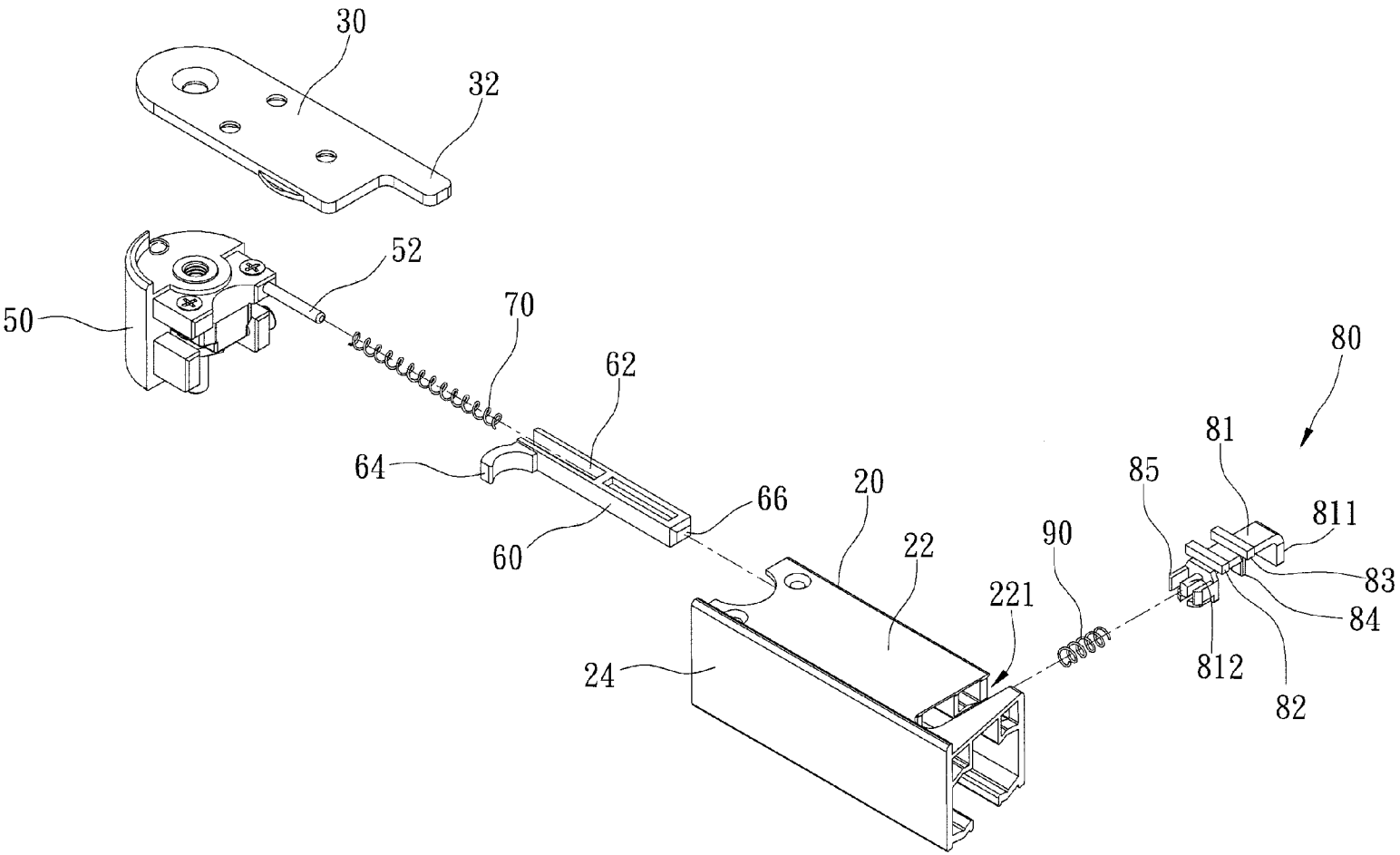
FIG. 4 is an exploded view of the preferred embodiment of the present invention.

In an embodiment, the first flexible member 70 is a spring, having opposite ends engaging the rod 52 of the base 50 and urging an inner end of the elongated slot 62 of the first restricting member 60 to urge the first restricting member 60. While the second rail 20 is at the first position P1 the protrusion 66 passes through the second rail 20 and enters the locking slot 12 of the first rail 10 (FIG. 2).

The second restricting member 80 has an elongated plate 81 received in the transverse slot 221 of the second rail 20. The elongated plate 81 has a pressing portion 811 and a rod 812 at opposite ends. The elongated plate 81 further has a block 82 and a stop rod 83 at a top thereof. The stop rod 83 is closer to the frame 100 than the block 82. Both the block 82 and the stop rod 83 press the top plate 22 of the second rail 20 so that the second restricting member 80 moves with the second rail 20 and is limited by the transverse slot 221. The stop rod 83 touches the protrusion 32 of the fixed member 30, and the pressing portion 811 touches the frame 100 when the second rail 20 is turned to the first position P1. The elongated plate 81 is provided with a stop plate 84 at a bottom thereof and a stop block 85 beside the rod 812. The stop block 85 is received in the second rail 20, and the stop plate 84 is closer to the frame 100 than the stop block 85.

In an embodiment, the second flexible member 90 is a spring, having opposite ends engaging the rod 812 of the second restricting member 80 and urging an interior side of the side plate 24 of the second rail 20. The second flexible member 90 urges the second restricting member 80 out of the transverse slot 221 of the second rail 20.

FIG. 7 shows the sashes 101, 102 in an expanding condition to close the window. As shown in FIG. 2, in the expanding condition, the second rail 20 is at the first position P1 and is connected to the first rail 10. At this time, the first restricting member 60 is urged by the first flexible member 70 to have the protrusion 66 passing through a space between the pressing portion 811 and the stop plate 84 of the second restricting member 80, and engaging the locking slot 12 of the first rail 10. As a result, the second rail 20 is secured to the first rail 10.

Figure 8:
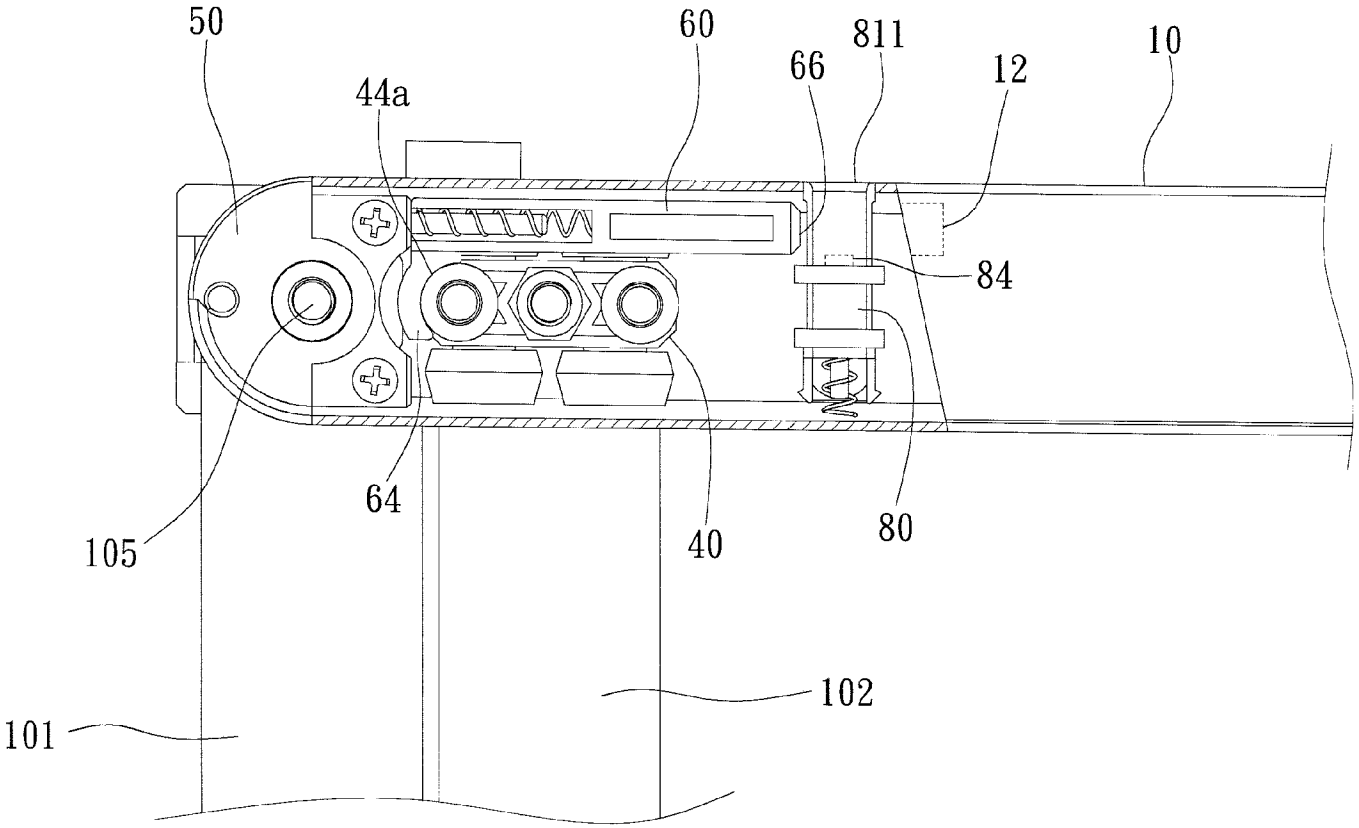
FIG. 8 is a sectional view of the preferred embodiment of the present invention, showing the elements inside the second rail when the sashes are folded.

As shown in FIG. 7, while the second sash 102 is drawn to the left, the pulley assembly 40 moves in the first rail 10 and toward the second rail 20, and it will turn the sashes 101, 102. Finally, the sashes 101, 102 fold up and are vertical to the first rail 10 and the second rail 20. At this time, the pulley assembly 40 moves into the second rail 20, and the driving portion 44*a* of the pulley assembly 40 touches the contacting portion 64 of the first restricting member 60 and pushes the first restricting member 60 and make the protrusion 66 out of the locking slot 12 of the first rail 10 (FIG. 8). The protrusion 66 leaves the space between the pressing portion 811 and the stop plate 84 as well.

Figure 10:
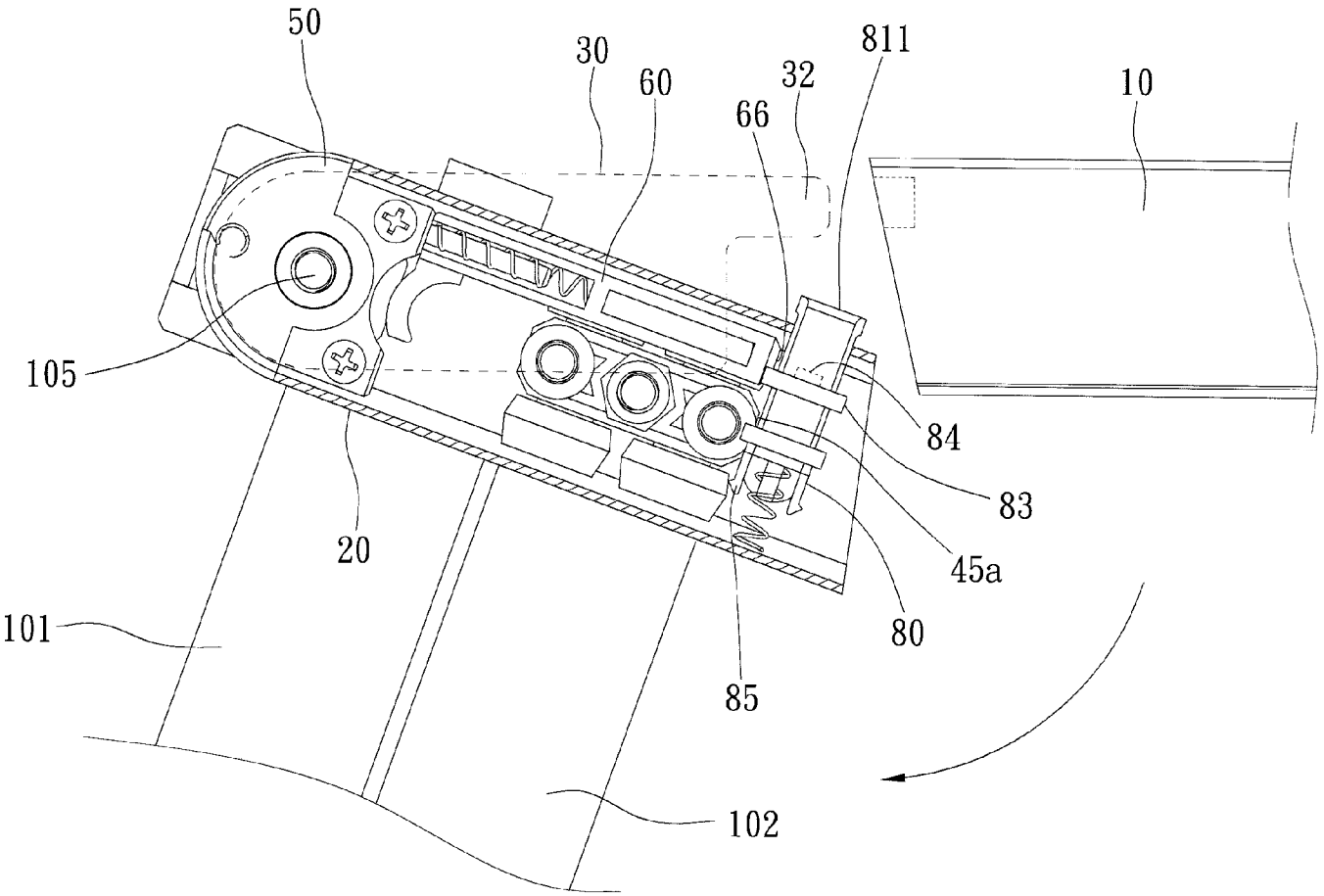
FIG. 10 is a sectional view of the preferred embodiment of the present invention, showing the elements inside the second rail when the second rail is moved to the second position.

As shown in FIG. 9 and FIG. 10, the user then turns the folded sashes 101, 102 to the left. It will turn the second rail 20 to the second position P2 from the first position P1 and separate the second rail 20 from the first rail 10 at the same time. At this time, the stop rod 83 leaves the protrusion 32 of the fixed member 30, and the second restricting member 80 is moved by the second flexible member 90 to move the pressing portion 811 out of the transverse slot 221. At the same time, it will move the stop plate 84 and the stop block 85 in the same direction. As shown in FIG. 10, after the second rail 20 leaves the first rail 10, the stop portion 45*a* of the pulley assembly 40 is stopped by the stop block 85 of the second restricting member 80, and the protrusion 66 of the first restricting member 60 is stopped by the stop plate 84 of the second restricting member 80, so that the pulley assembly 40 and the first restricting member 60 will never escape from the second rail 20 even when the sashes 101, 102 are turned in a reverse way.

Figure 1:
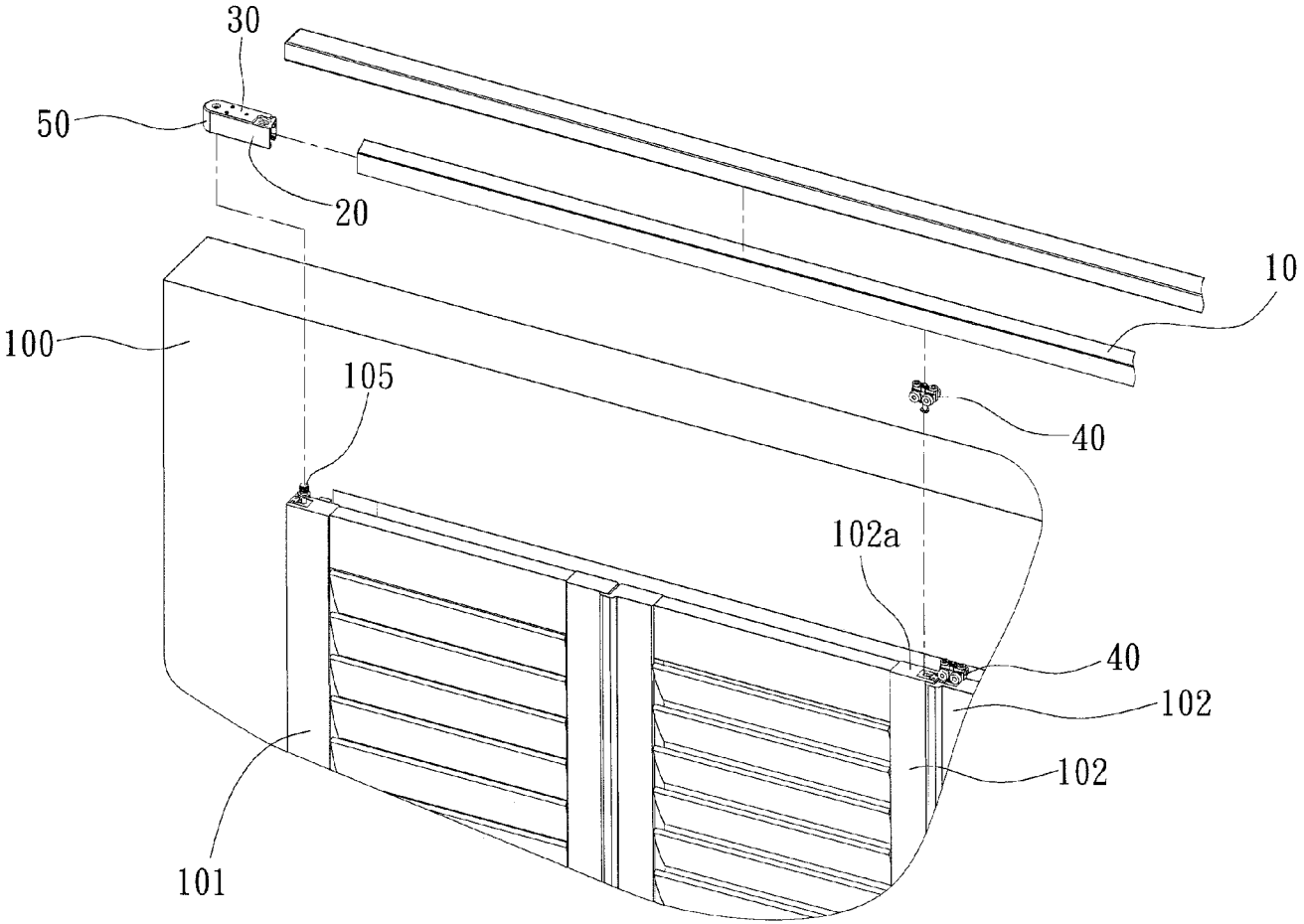
FIG. 1 is a perspective view of a preferred embodiment of the present invention.

As a result, the user may turn the sashes 101, 102 for another ninety degrees, and attach the sashes 101, 102 to a wall of the building, as shown in FIG. 9. It is obvious that the sashes 101, 102 move totally off the window that may provide the maximum window opening space when the window is opened. In addition, the sashes 101, 102 are attached to the wall beside the window so that people will not run into them. On the contrary, when the user wants to close the window, he/she just moves the sashes 101, 102 in a reverse way. The second rail 20 will be turned to the first position P1 and reengages the first rail 10 when the sashes 101, 102 are turned back. At this time, the stop rod 83 of the second restricting member 80 touches the protrusion 32 of the fixed member 30, and the pressing portion 811 presses the frame 100. It may compress the second flexible member 90 and move the second restricting member 80 into the second rail to move the second restricting member 80 back to the position when the second rail 20 is not separated. In practice, it may move the second restricting member 80 by the touching of the top rod 83 and the protrusion 32, or the pressing portion 811 and the frame 100 only. Now, the pulley assembly 40 may be freely move back to the first rail 10 and the sashes 101 and 102 back to the expanding condition, as shown in FIG. 1.

It is noted that both the first rail 10 and the second rail 20 are straight in the present invention to achieve the same result of a conventional warped rail, so that the present invention is cheaper and easier to manufacture.

In above embodiment, it discloses a window covering with two sash members, and each sash member has two hinged sashes. The present invention may be applied in a covering having one sash member with two sashes, or a sash member having more than two sashes.

The description above is only a few preferred embodiments of the present invention. The concept of the present invention may be incorporated in, except for window, door, any type of the covering which shades an opening of a building. The equivalence of the present invention is still in the scope of claim construction of the present invention.

What is claimed is:

1. A rail module of a covering of a building's opening, comprising:

a fixed first rail having a locking slot;

a second rail being turned between a first position and a second position, wherein the second rail is connected to the first rail when the second rail is turned to the first position, and the second rail is separated from the first rail when the second rail is turned to the second position; and a first restricting member, which is movably provided on the second rail, having a contacting portion and a protrusion at opposite sides thereof, wherein the protrusion engages the locking slot of the first rail when the second rail is turned to the first position;

a pulley assembly being able to move in the first rail and the second rail when the second rail is turned to the first position, wherein the pulley assembly has a driving portion in association with the contacting portion of the first restricting member;

wherein the driving portion of the pulley assembly touches the contacting portion of the first restricting member to move the first restricting member and disengage the protrusion of the first restricting member with the locking slot of the first rail when the pulley assembly is moved into the second rail, so that the second rail is able to be turned to the second position; and a second restricting member having a stop block, wherein the pulley assembly has a stop portion in association with the stop block, and the stop portion touches the stop block to prevent the pulley assembly moving out of the second rail when the second rail turns to the second position from the first position and the pulley assembly is moved toward the second restricting member;

wherein the second restricting member is moved to a predetermined position to block both the first restricting member and the pulley assembly when the second rail leaves the first position, so that the first restricting member and the pulley assembly are restricted in the second rail, and the second restricting member is moved away from the predetermined position when the second rail is turned back to the first position, whereby the protrusion of the first restricting member is engaged with the locking slot of the first rail, and the pulley assembly is able to be moved into the first rail.

2. The rail module as defined in claim 1, further comprising a first flexible member to urge the first restricting member toward the first rail.

3. The rail module as defined in claim 2, further comprising a base, which is received in the second rail for rotation, having a rod, wherein the first restricting member has an elongated body, on which the contacting portion, an elongated slot, and a protrusion are provided; the elongated slot and the protrusion are on opposite ends of the elongated body; the rod engages the elongated slot; the first flexible member has an end engaging the rod, and an opposite end received in the elongated slot.

4. The rail module as defined in claim 1, further comprising a second flexible member to urge the second restricting member away from the second rail.

5. The rail module as defined in claim 4, wherein the second rail has a top plate and two side plates connected to opposite edges of the top plates; the top plate has a transverse slot; the second restricting member has an elongated plate engaging the transverse slot and a block on a top of the elongated plate; the block presses the top plate; the stop block is provided on a bottom of the elongated plate; the elongated plate has a rod; the second flexible member has an end engaging the rod of the elongated plate and an opposite end urging an interior side of the side plate to urge the elongated plate out of the transverse slot.

6. The rail module as defined in claim 5, further comprising a fixed member, which is above the top plate of the second rail, wherein the fixed member has a protrusion; the second restricting member has a stop rod on the top of the elongated plate; the stop rod touches the protrusion of the fixed member when the second rail is turned to the first position.

7. The rail module as defined in claim 1, wherein the second restricting member has a stop plate to touch the protrusion of the first restricting member when the second rail turns to the second position from the first position.

* * * * *